US008667871B2

(12) United States Patent
Ahrens

(10) Patent No.: US 8,667,871 B2
(45) Date of Patent: Mar. 11, 2014

(54) TELESCOPING EXTENSION TOOL

(76) Inventor: Larry C. Ahrens, Jackson, MO (US)

( * ) Notice: Subject to any disclaimer, the term of this patent is extended or adjusted under 35 U.S.C. 154(b) by 340 days.

(21) Appl. No.: 12/930,650

(22) Filed: Jan. 13, 2011

(65) Prior Publication Data

US 2012/0180605 A1 Jul. 19, 2012

(51) Int. Cl.
*B25B 23/16* (2006.01)

(52) U.S. Cl.
USPC ..... 81/177.2; 81/177.85

(58) Field of Classification Search
USPC ..... 81/177.2, 177.85
See application file for complete search history.

(56) References Cited

U.S. PATENT DOCUMENTS

| | | | | |
|---|---|---|---|---|
| 1,741,810 | A | 8/1928 | Bidal | |
| 3,227,015 | A | 1/1966 | Tremblay | |
| 3,306,639 | A | 2/1967 | Lyon | |
| 4,367,663 | A | 1/1983 | Merics | |
| 4,376,397 | A | 3/1983 | Newby | |
| 4,754,670 | A * | 7/1988 | Raymond | 81/177.2 |
| 4,856,388 | A * | 8/1989 | Freeman | 81/177.2 |
| 4,905,548 | A | 3/1990 | Colace | |
| 5,927,161 | A * | 7/1999 | Clifford et al. | 81/177.2 |
| 6,038,946 | A * | 3/2000 | Jackson et al. | 81/177.2 |
| 6,971,290 | B1 | 12/2005 | Ybarra | |
| 7,185,568 | B1 | 3/2007 | Vance | |
| 7,188,553 | B1 * | 3/2007 | Pryor | 81/177.2 |

FOREIGN PATENT DOCUMENTS

| | | |
|---|---|---|
| DE | 298 20 044 | 11/1999 |
| DE | 10 2004 017711 | 10/2005 |
| WO | WO 2004/015281 A2 | 2/2004 |

* cited by examiner

*Primary Examiner* — Lee D Wilson
*Assistant Examiner* — Shantese McDonald
(74) *Attorney, Agent, or Firm* — Douglas E. Warren

(57) ABSTRACT

A telescoping extension tool for use in combination with a socket wrench is disclosed herein. Embodiments of the telescoping extension tool are installed onto the socket wrench to extend the reach of the socket used in combination with the socket wrench. Because the extension tool is telescoping, the reach of the telescoping extension tool is infinitely adjustable between the shortest extension and the longest extension of the telescoping tool. Additionally, the external surfaces of certain components of embodiments of the present invention allow the use of other tools designed to grip hexagonal shapes to supply the rotation and torque necessary to loosen or tighten fasteners.

11 Claims, 4 Drawing Sheets

TELESCOPING EXTENSION TOOL

CROSS REFERENCE TO RELATED APPLICATIONS

Not applicable.

STATEMENT REGARDING FEDERALLY SPONSORED RESEARCH

Not Applicable.

FIELD OF THE INVENTION

This disclosure relates to the field of hand tools and more specifically to the field of socket wrenches and socket wrench accessories.

BACKGROUND OF THE INVENTION

This section provides general background information related to the present disclosure and the background information is not necessarily prior art.

There are a wide variety of various tools that have been developed for removal and installation of all types of bolts, nuts, and other generally hexagonal fasteners. Of those tools, the most common tool is a socket wrench combination that includes a wrench having a handle upon which a square drive end has been incorporated, usually at a right angle to the handle axis. In general operation, a female socket is attached to the square drive end of the handle. In most cases the handle also incorporates a ratcheting mechanism that allows a fastener to be rotated a full 360 degrees with as little as only 5 to 10 degrees rotation of the handle.

Various assorted attachments have been developed that can be used with the socket wrench. In many cases, the attachments act to provide better access to a fastener to be worked upon and allow the handle to be rotated as easily as possible while placing the socket at a position that best engages the fastener. For example, one accessory for the socket wrench includes a universal joint that attaches to the square drive end of the handle and then, through a set of yokes included in the universal joint, allows the transference of the torque from the socket wrench to a fastener that is otherwise hard to reach.

One class of attachments for the socket wrench are extensions that attempt to extend the reach of the socket wrench to allow the socket to engage in fasteners that are not within the reach of the standard socket wrench and socket combination. Those accessories are classified as socket extensions and are positioned between the square end drive of the socket wrench and the socket to relocate the socket at a greater distance from the square end drive of the socket wrench than the socket would be if the socket was instead attached directly to the square end drive. Within the tool industry, socket extensions are normally made in discrete increments of length. For example, socket extensions come in standard lengths of 3.0 inches, 6.0 inches and 10.0 inches. In combination, socket wrenches, sockets, and socket accessories have provided a useful and common method of installing and removing various types of fasteners.

While these standard length extensions are useful for most applications, there are other applications where the clearance available for access to a fastener simply does not allow for the use of standard length extensions because the length of the extension needed does not fall within the discrete 3.0 increments found in standard socket extensions.

SUMMARY OF THE INVENTION

This section provides a general summary of the disclosure, and is not a comprehensive disclosure of its full scope or all of its features.

In accordance with the various embodiments of the present invention, this invention relates to a telescoping extension tool that allows a socket to be extended from a socket wrench in increments that can be infinitely adjustable between the shortest reach and the longest reach of the telescoping extension tool.

Further areas of applicability will become apparent from the description provided herein. The description and specific examples in this summary are intended for purposes of illustration only and are not intended to limit the scope or the claims of the present disclosure.

DESCRIPTION OF THE DRAWINGS

In the accompanying drawings which form part of this specification.

Corresponding reference numerals indicate corresponding steps or parts throughout the several figures of the drawings.

Figure 1:
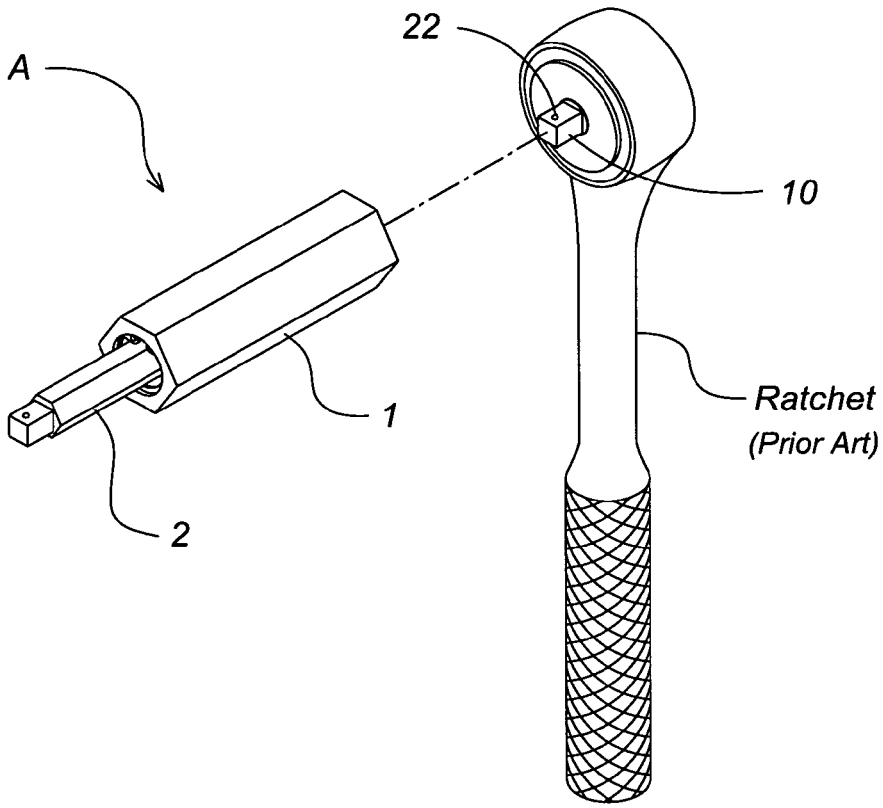
FIG. 1 shows a perspective view of one embodiment of the present invention and how it may be combined with a prior art ratchet.
Figure 2:
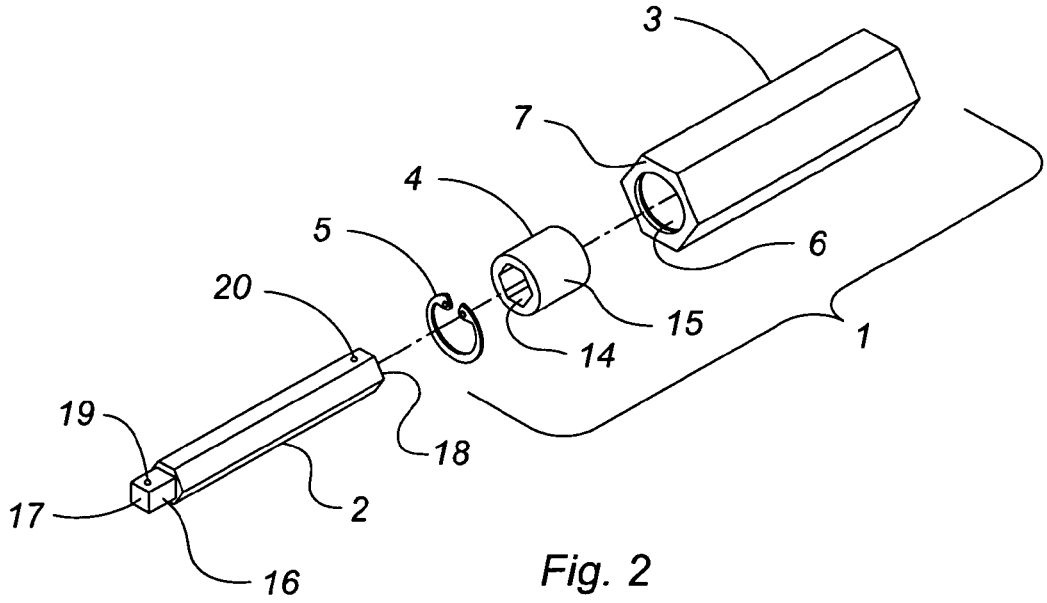
FIG. 2 shows an exploded perspective view of one embodiment of the present invention.

While one embodiment of the present invention is illustrated in the above referenced drawings and in the following description, it is understood that the embodiment shown is merely one example of a single preferred embodiment offered for the purpose of illustration only and that various changes in construction may be resorted to in the course of manufacture in order that the present invention may be utilized to the best advantage according to circumstances which may arise, without in any way departing from the spirit and intention of the present invention, which is to be limited only in accordance with the claims contained herein.

DETAILED DESCRIPTION OF A PREFERRED EMBODIMENT OF THE INVENTION

In the following description, numerous specific details are set forth such as examples of some preferred embodiments, specific components, devices, methods, in order to provide a thorough understanding of embodiments of the present disclosure. It will be apparent to a person of ordinary skill in the art that these specific details need not be employed, and should not be construed to limit the scope of the disclosure. In the development of any actual implementation, numerous implementation-specific decisions must be made to achieve the developer's specific goals, such as compliance with system-related and business-related constraints. Such a development effort might be complex and time consuming, but is nevertheless a routine undertaking of design, fabrication, and manufacture for those of ordinary skill.

A preferred embodiment of the present invention is illustrated in the drawings and figures contained within this specification. More specifically, preferred embodiments of the present invention are generally disclosed in FIGS. 1-6.

Referring now to FIG. 1, a telescoping extension tool A is shown. The telescoping extension tool A comprises a retention housing 1 and an extendable portion 2.

In the present embodiment, the retention housing 1 (FIG. 2) comprises a retention sleeve 3, a retainer 4, and a snap ring 5. The retention sleeve 3 is generally hexagonally shaped and has a substantially hexagonal opening 6 in a proximate end 7 of the retention sleeve. The retention sleeve 3 also includes a square opening 8 (FIG. 5 & FIG. 6) in a distal end 9 of the retention sleeve. It will be appreciated by those of skill in the art that the square opening 8 is centered on the distal end 9 of the retention sleeve and that the general purpose of the square opening is to allow the telescoping extension tool A to be mounted onto the ratchet drive element 10 (FIG. 1) of a standard socket ratchet. It is also understood than in applications where the telescoping extension tool A is not used, a standard female socket would be mounted onto the ratchet drive element 10. In contrast, when the telescoping extension tool A is used, the telescoping extension tool A would be mounted onto the ratchet drive element 10 first, and then the female socket would be mounted onto the end of the extendable portion 2.

The square opening 8 (FIG. 5) is sized to fit the ratchet drive element 10 (FIG. 1). For example, if a ⅜ inch drive ratchet is to be used, the square opening 8 would be sized to fit the ratchet drive element 10 of a ⅜ inch ratchet. The same would apply to other standard ratchet sizes such as ¼ inch and ½ inch ratchets.

The retention sleeve 3 (FIG. 5 & FIG. 6) also includes at least one semispherical opening 21 located within the square opening 8. One purpose of the semispherical openings 21 is to engage with the detention ball 22 (FIG. 1) of the ratchet drive element 10. Additionally, the retention sleeve 3 (FIG. 5 & FIG. 6) also includes a second set of semispherical indentions 23 on each of the six hexagonal surfaces of the hexagonal opening 6 of the retention sleeve. The second set of semispherical openings 23 is located within the hexagonal opening 6 between about 1.0 inch and about 1.5 inch from the proximate end 7 of the retention sleeve 3.

The retention sleeve 3 includes a counterbore 11 in the proximate end 7 of the retention sleeve 3. The counterbore 11 begins at the proximate end 7 of the retention sleeve 3 and extends into the hexagonal opening 6 to a limited depth. The size and depth of the counterbore 11 is as needed to allow for the installation of the retainer 4 into the counterbore. The retention sleeve 3 also includes a groove 12 that is also located near the proximate end 7 of the retention sleeve. It is understood that the groove 12 is sized and located to allow for the placement of the snap ring 5 into the groove and that the snap ring has an interior opening sized to allow for the slideable insertion and removal of the extension portion 2. It is also understood that the groove 12 is located nearer the proximate end 7 of the retention sleeve 3 and that the groove is further located between the counterbore 11 and the surface 13 of the proximate end of the retention sleeve.

The retainer 4 (FIG. 2) has a generally circular outside surface 15 and a second hexagonal opening 14. The second hexagonal opening 14 is sized to allow for a sliding fit between the retainer 4 and the extendable portion 2. It will be appreciated that one purpose of the retainer 4 is to maintain a sliding grip relationship with the hexagonal shape of the extendable portion 2. The retainer 4 is made of a resilient material such as neoprene or rubber and, as such, it is understood that the sliding grip relationship between the second hexagonal opening of the retainer 4 and the extendable portion 2 can allow for a slight interference fit between the retainer 4 and the extendable portion 2 in some embodiments of the present invention. In alternate embodiments, the retainer 4 can be made from a resilient material selected from the group consisting of neoprene, rubber, vinyl, expanded polystyrene, expanded polypropylene, ethylene-vinyl acetate copolymer, polyethylene, and urethane foam as needed to adapt the telescoping extensions tool A to specific applications and situations.

The extendable portion 2 in the present embodiment is substantially hexagonal in shape and includes a square end 16 on a proximate end 17 of the extendable portion. At least one surface of the square end 16 includes a first detention device 19 intended to either grip or engage with related elements of a socket that has been mounted onto the extendable portion 2. A second detention device 20 is located on one of the surfaces of the hexagonal shape of the extendable portion 2 near the distal end 18 of the extendable portion at between about 1.0 inch and about 1.5 inches from the distal end 18. The location of the second detent device 20 can be adjusted as need to fit a particular application of the present device and as needed to allow the second detention device to engage the second spherical indentations 23 of the retention sleeve 3. In the present embodiment, the first detention device 19 and the second detention device 20 include a spherically shaped detent ball that is spring loaded and installed into the body of the extendable portion such that the spring biases the spherical detent ball away from the longitudinal axis of the extendable portion 2.

It is understood that one purpose of the second detent device 20 is to retain at least some part of the extendable portion 2 within the retention sleeve 3. This is to say that, when assembled, the present embodiment of the telescoping extension tool A includes installation of the retainer 4 into the retention sleeve 3 with installation of the snap ring 5 into the groove 12 (FIG. 5 & FIG. 6) to retain the retainer into position in the counterbore 11. When the extendable portion 2 is being installed into the retention sleeve 3, the second retention device 20 (FIG. 2, FIG. 5, & FIG. 6) moves past the snap ring 5 and the retainer 4 until the distal end 18 of the extendable portion is at or near the end of the hexagonal opening 6. It is appreciated that, as the extendable portion 2 is inserted in this manner, the snap ring 5 and/or the retainer 4 depress the second detention device 20 as the extendable portion is being inserted into the retention sleeve 3. When the second detention device 20 has passed the snap ring 5 and/or the retainer 4, the ball of the second detention device is bias outward away from the surface of the hexagonal shape of the extendable portion 2. Because the second detention device 20 thus protrudes from the surface of the extendable portion 2, the second detention device will engage with the second set of indentations 23 to inhibit the extendable portion from being further removed from the retention sleeve 3. Should the extendable portion 2 be further extended, the second detention device 20 would then come into contact with one of either the retainer 4 or the snap ring 5 to alternatively inhibit the extendable portion from being further removed from the retention sleeve 3. Therefore, the interaction of the second detention device 20 and one of either the second set of indentations 23, the retainer 4, or snap ring 5 tends to inhibit the full removal of the extendable portion 2 from within the hexagonal opening 6 of the retention sleeve 3.

While the present embodiment uses the second retention device to keep the extendable portion 2 retained within the retention sleeve 3, it is understood that other methods can be used to retain the extendable portion into the retention sleeve. For example, in alternative embodiments the second retention device 20 can be replaced with a retention pin that could be inserted through both the retention sleeve 3 and the extendable portion 2. In fact, any method can be used as long as the method selected tends to prevent the disengagement of the extendable portion 2 from the retention sleeve 3.

Figure 7:
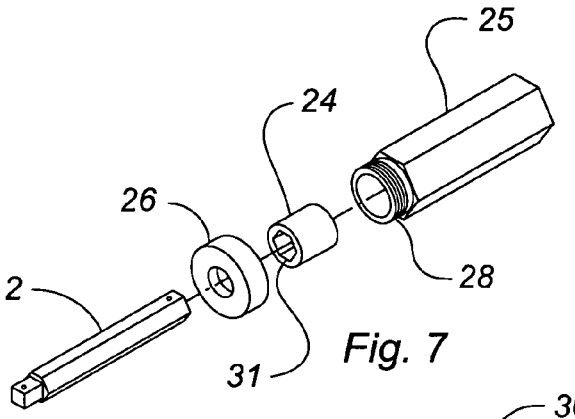
FIG. 7 shows an exploded perspective view of a second embodiment of the present invention.
Figure 9:
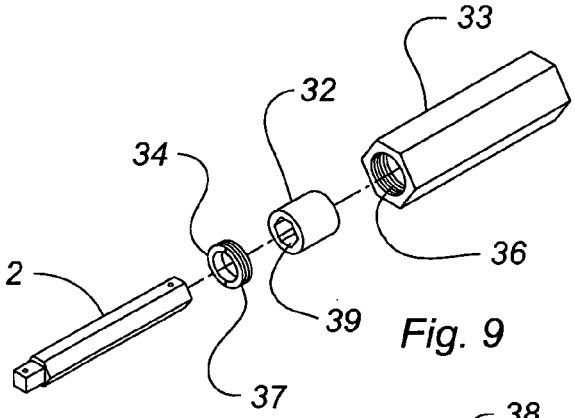
FIG. 9 shows an exploded perspective view of a third embodiment of the present invention.

FIG. 7 and FIG. 9 show a second embodiment and a third embodiment, respectively, of the present invention. The second and third embodiments are generally the same as the first embodiment shown in FIG. 1 through FIG. 6 except the method used to hold the retainer (4 in the first embodiment above) within the retention sleeve (3 in the first embodiment above) is different.

Figure 8:
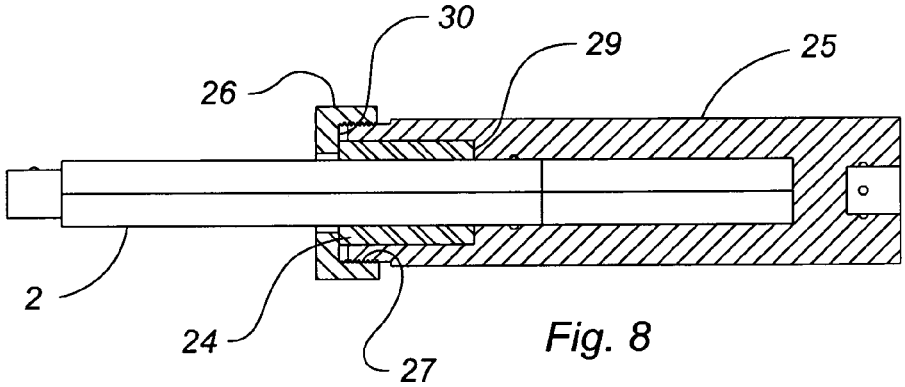
FIG. 8 shows a vertical cross section of a second embodiment of the present invention with the extendable portion extended from the retention housing.

In FIG. 7 the second retainer 24 is installed with the second retention sleeve 25 with a cap 26. As shown in FIG. 8, the cap 25 of the second embodiment includes an internal threaded portion 27 that matches an external threaded portion 28 on the second retention sleeve 25. The second retention sleeve 25 has a second counterbore 29 similar to the counterbore 11 of the first embodiment. However, in this second embodiment, the depth of the second counterbore 29 into the second retention sleeve 25 is less the overall length of the second retainer 24. As seen in FIG. 8, this allows the second retainer 24 to protrude somewhat from the end of the second retention sleeve 25. The amount of extension may be as necessary to fulfill the functions of the retention of the second retainer 24, however, a preferred embodiment would have the second retainer 24 extending from the end of the second retention sleeve 25 between about 1/16 inch and about 3/16 inch.

It is understood that when the cap 26 is installed onto the second retention sleeve 25 while the second retainer 24 is inserted into the second counterbore 29, an underside 30 of the cap 26 contacts the second retainer. As the cap 26 is further screwed onto the second retention sleeve 25, the underside 30 of the cap 26 applies more and more pressure against the second retainer 25 thereby compressing the second retainer into the second counterbore 29. As the pressure on the second retainer 24 increases the elasticity of the second retainer material causes the second retainer to place more and more pressures on the sides of the extendable portion 2 that is inserted into a third hexagonal opening 31 of the second retainer. This increased pressure on the extendable portion 2 tends to prevent the extendable portion from moving into and out of the second retention sleeve 25. This not only allows for a setting of the initial pressure of the second retainer 25 to hold the extendable portion 2 in position during initial assembly, this also allows for future adjustment of the pressure applied by the second retainer 24 against the extendable portion when time and wear has cause the third hexagonal opening 31 in the second retainer to enlarge slightly to allow the extendable portion 2 to more easily move into and out of the second retention sleeve 25.

It will be appreciated by those of skill in the art that an extremely loose extendable portion 2 can be annoying to a user when the second retainer 24 does not inhibit the extendable portion from slipping into and out of the second retention sleeve 25. Thus, one advantage of using the threaded cap 26 and the external threaded portion 28 of the second retention sleeve 25 is to allow the user to periodically tighten the cap to force the second retainer 24 harder against the extendable portion 2 to again prevent the extendable portion from moving to too easily into and out of the second retention sleeve 25.

Figure 10:
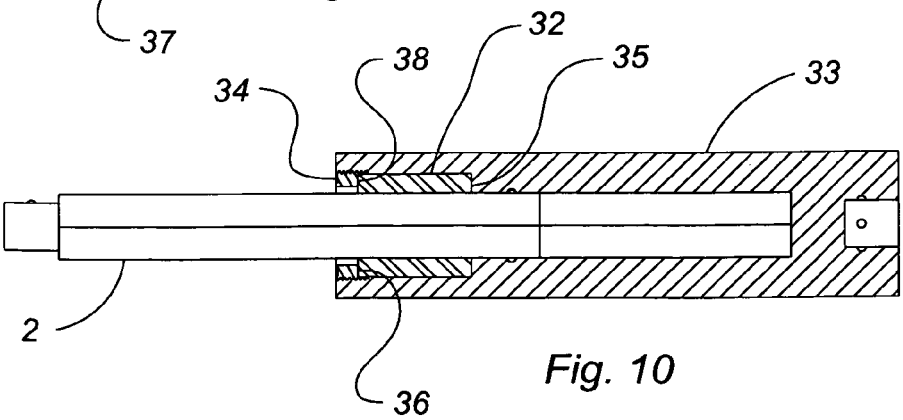
FIG. 10 shows a vertical cross section of a third embodiment of the present invention with the extendable portion extended from the retention housing.

In the third embodiment of the present invention as shown in FIG. 9 and FIG. 10, the arrangement is generally the same as the second embodiment. However, the cap is externally threaded and the retention sleeve is internally threaded.

More specifically, FIG. 9 and FIG. 10 show a third retainer 32, a third retention sleeve 33, and a second cap 34 of a third embodiment of the present invention. Similar to the above embodiments, the third retainer 32 is installed into a third counterbore 35 and is generally held in place by the second cap 34. It is understood that the depth of the third counterbore 35 is sufficient to allow for the placement of the third retainer 32 into the third counterbore while still allowing the placement of a second internal threaded portion 36 at one end of the third counterbore. This is to say, the internal threaded portion 36 will overlap the length of the third retainer 23 and extend beyond the end of the third retainer when the third retainer is fully installed within the third counterbore.

The second cap 34 includes a second external threaded portion 37 that is sized to engage with the second internal threaded portion 36 of the third counterbore 35. It is understood that the depth of the second internal threaded portion 36 is deep enough that the overall length of the third retainer 32 will be between about 1/6 inch and about 3/16 inch greater than the portion of the third counterbore 35 that is unthreaded. In this way, the third retainer 32 is placed within the third counterbore 35 and the second cap 34 is then installed into the third counterbore by engaging the second external threaded portion 37 of the second cap with the second internal threaded portion 36 of the third retention sleeve 33. As the second cap 34 is tightened, the underside 38 of the second cap applies pressure onto the third retainer 32 to force the third retainer deeper into the third counterbore 35.

As with the second embodiment of the present invention, the pressure that the second cap 34 places on the third retainer 32 tends to deform the third retainer material to reduce the general size and configuration of the fourth hexagonal opening 39 against the extendable portion 2 inserted into the fourth hexagonal opening. This again allows for the adjustment of the pressure the third retainer 32 places on the extendable portion 2 and allows the user to adjust the movement of the extendable portion into or out of the third extension sleeve 33 when time and use allow the extendable portion to move too easily into or out of the third extension sleeve 33. Thus, if the extendable portion 2 is too loose, the user can tighten the second cap 34 further into the third retention sleeve 33 and that applies more pressure on the third retainer 32 thereby forcing the third retainer to tighten its grip on the outside of the extendable portion 2.

In operation, a user of the telescoping extension tool A will first identify the need for the telescoping extension tool A to reach a fastener that is less accessible using standard socket wrench tool extension accessories. The user then attaches the telescoping extension tool A to the socket wrench by insertion of the drive element 10 (FIG. 1) into the square opening 8 (FIG. 5 & FIG. 6) of the retention sleeve 3. In a preferred embodiment, the detention ball 22 of the ratchet drive element 10 will engage with at least one of the semispherical openings 21 of the square opening 8 of the retention sleeve 3.

Figure 3:
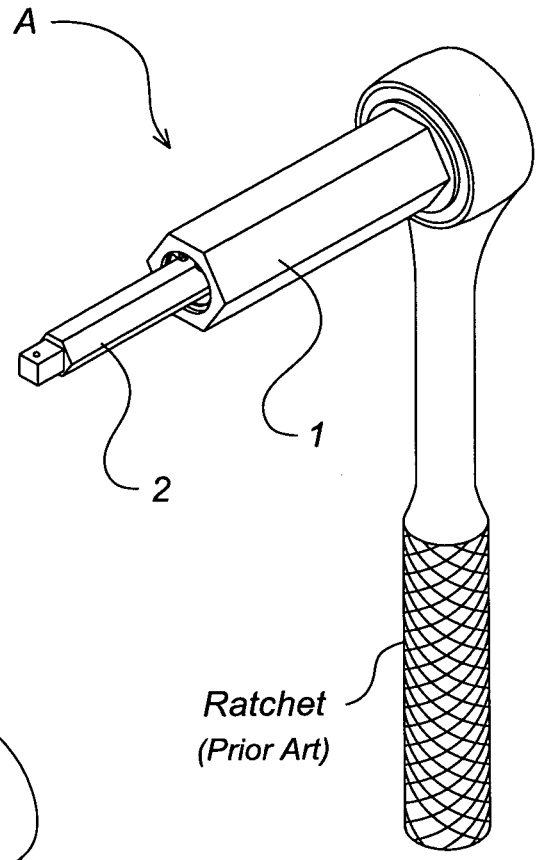
FIG. 3 shows a perspective view of one embodiment of the present invention working combination with a ratchet and shows that embodiment in an extended condition.
Figure 4:
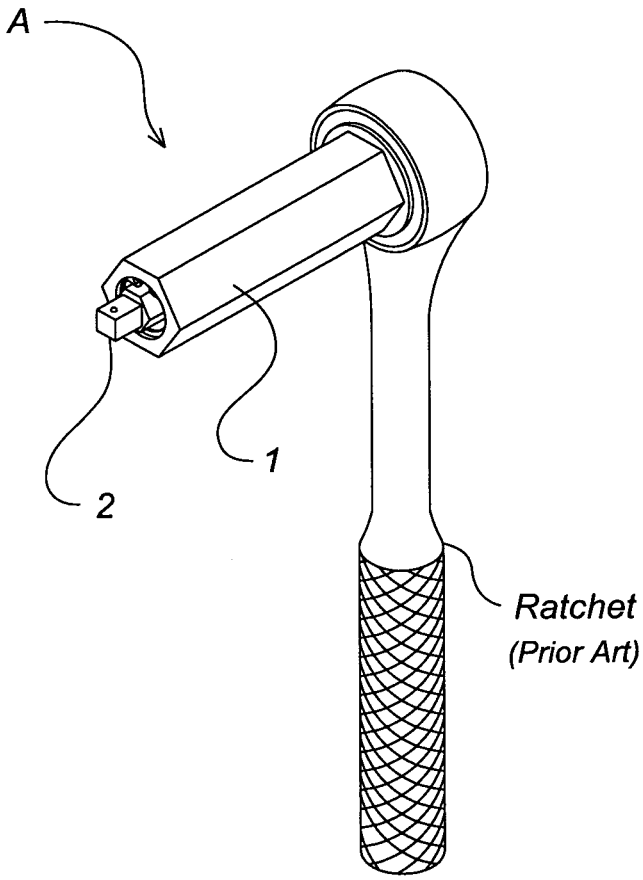
FIG. 4 shows a perspective view of one embodiment of the present invention working in combination with a ratchet and shows that embodiment in a retracted condition.
Figure 5:
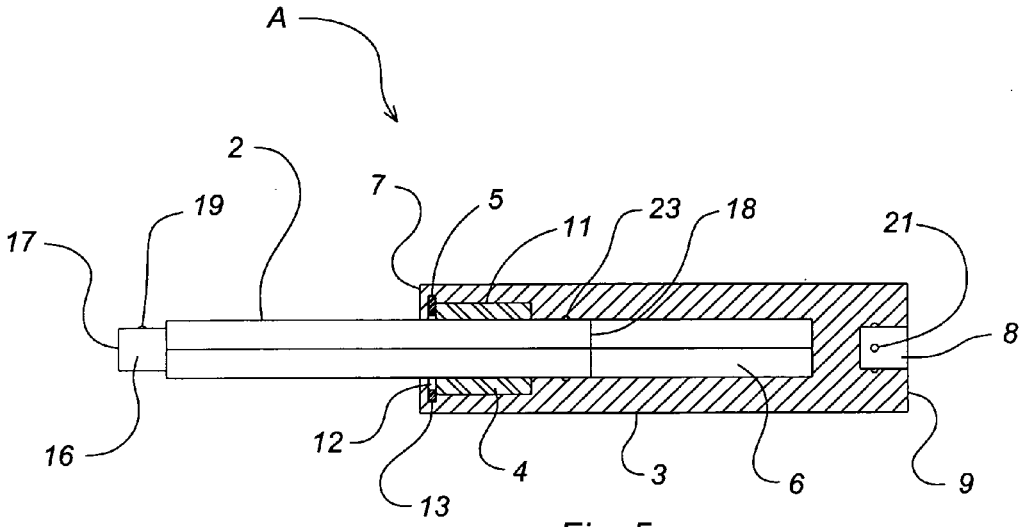
FIG. 5 shows a vertical cross section of one embodiment of the present invention with the extendable portion extended from the retention housing.
Figure 6:
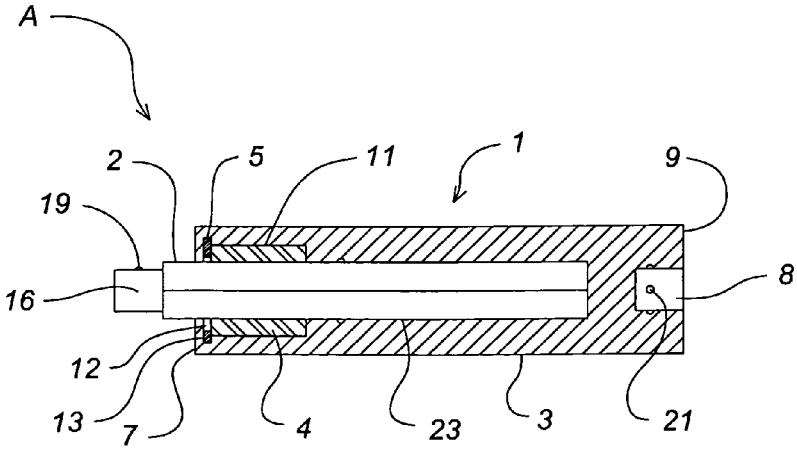
FIG. 6 shows a vertical cross section of one embodiment of the present invention with the extendable portion inserted into the retention housing.

After the telescoping extension tool A has been mounted onto the ratchet, the distance between the ratchet and the square end 16 is adjusted by either sliding the extendable portion 2 fully into the retention sleeve 3 as shown in FIG. 4, or by fully extending the extendable portion by pulling the extendable portion from within the retention sleeve as depicted in FIG. 3. Alternatively, the extendable portion 2 can be positioned at any point between being fully inserted into the retention sleeve and fully extended from the retention sleeve, as necessary for the specific application. As noted above, the second detent device 20 (FIG. 2) will engage with the second set of semispherical indentations 23 (FIG. 5 & FIG. 6) to inhibit the ability to extend the extendable portion further to prevent the extendable portion 2 from being extended from the retention sleeve 3 to a point where damage may be possible to the telescoping extension tool A, and to signal the user that the full extension point has been achieved. Once the position of the extendable portion 2 is determined by the user, a standard socket is mounted onto the telescoping extension tool A by placement of the socket onto the square end 16 of the extendable portion 2.

It will be appreciated by those of skill in the art that the design of certain embodiments of present invention allow for an infinite range of adjustment between the fully inserted and fully extended extendable portion. This is in contrast to many previous inventions that only allow for specific incremental adjustments of 3.0 inches to extend reach of those previous tools.

In the present embodiment, the distance between having the extendable portion 2 fully inserted into the retention housing 1 and having the extendable portion extended from the retention housing is between about 1.50 inches and about 6.0 inches. It is understood that this distance can be varied and adapted as need for alternative specific applications of the telescoping extension tool A and still remain within the scope of the present invention.

The user of the combination of the socket wrench ratchet and the telescoping extension tool A positions the socket over the head of the fastener and allows the user to either remove or tighten the fastener. It is understood that the rotation of the ratchet drive element 10 (FIG. 1) is transferred to the socket mounted onto the telescoping extension tool A because the size of the hexagonal shape of the extendable portion 2 (FIG. 2, FIG. 5, & FIG. 6) is sufficiently close to the internal size of the hexagonal opening 6 of the retention sleeve 3 such that the matching hexagonal shapes of the hexagonal opening of the retention sleeve and the outside surface of the extendable portion engage sufficiently to transfer the rotation and torque of the ratchet through the telescoping extension tool A and the socket to act on the fastener being loosened or tightened.

It is also appreciated that the hexagonal shape of the extendable portion 2 allows for alternative methods of rotating the head of a fastener that is being removed or tightened. More specifically, it is noted that the hexagonal shape of the extendable portion 2 is similar to the hexagonal shape used on the head of many fasteners. Therefore, tools such as open-end wrenches, boxed-end wrenches, adjustable ("crescent") wrenches, pliers, and other similar tools can be operatively attached to the hexagonal shape of the extendable portion 2 and be rotated to tighten or remove a fastener. It is also noted that the hexagonal shape of the outer surface of the extension sleeve 3 allows those same types of tools to be placed on the outer surface of the retention sleeve to impart rotation and torque to a fastener being tightened or removed. Finally it is also noted that while the present embodiment describes a use of the telescoping extension tool A with a manual socket drive ratchet, the telescoping extension tool A may also be used with other tools such as electrically or pneumatically driven socket driving tools as long as any such tools have the appropriately sized square drive element 10 (FIG. 1) needed to fit the square opening 8 (FIG. 5 & FIG. 6) of the retention sleeve 3.

In the preceding description, numerous specific details are set forth such as examples of specific components, devices, methods, in order to provide a thorough understanding of embodiments of the present disclosure. It will be apparent to a person of ordinary skill in the art that these specific details need not be employed, and should not be construed to limit the scope of the disclosure. In the development of any actual implementation, numerous implementation-specific decisions must be made to achieve the developer's specific goals, such as compliance with system-related and business-related constraints. Such a development effort might be complex and time consuming, but is nevertheless a routine undertaking of design, fabrication and manufacture for those of ordinary skill. The scope of the invention should be determined by any appended claims and their legal equivalents, rather than by the examples given.

Additionally, it will be seen in the above disclosure that several of the intended purposes of the invention are achieved, and other advantageous and useful results are attained. As various changes could be made in the above constructions without departing from the scope of the invention, it is intended that all matter contained in the above descriptions or shown in the accompanying drawings shall be interpreted as illustrative and not in a limiting sense.

Terms such as "proximate," "distal," "upper," "lower," "inner," "outer," "inwardly," "outwardly," "exterior," "interior," and the like when used herein refer to positions of the respective elements as they are shown in the accompanying drawings, and the disclosure is not necessarily limited to such positions. Terms such as "first," "second," and other numerical terms when used herein do not imply a sequence or order unless clearly indicated by the context.

When introducing elements or features and the exemplary embodiments, the articles "a," "an," "the" and "said" are intended to mean that there are one or more of such elements or features. The terms "comprising," "including," and "having" are intended to be inclusive and mean that there may be additional elements or features other than those specifically noted. It is further to be understood that the method steps, processes, and operations described herein are not to be construed as necessarily requiring their performance in the particular order discussed or illustrated, unless specifically identified as an order of performance. It is also to be understood that additional or alternative steps may be employed.

It will also be understood that when an element is referred to as being "operatively connected," "connected," "coupled," "engaged," or "engageable" to and/or with another element, it can be directly connected, coupled, engaged, engageable to and/or with the other element or intervening elements may be present. In contrast, when an element is referred to as being "directly connected," "directly coupled," "directly engaged," or "directly engageable" to another element, there are no intervening elements present. Other words used to describe the relationship between elements should be interpreted in a like fashion (e.g., "between" versus "directly between," "adjacent" versus "directly adjacent," etc.).

What is claimed is:

1. A telescoping extension tool comprising:

a retention housing having a retention sleeve that is generally hexagonally shaped and has a generally hexagonal opening substantially aligned with the longitudinal axis of the retention sleeve, wherein the retention sleeve further comprises a retainer mounted therein such that the retainer tends to retain the extendable portion within the retention sleeve, and wherein the retention sleeve has a square opening at one end of the retention sleeve that is sized and configured to fit a standard socket wrench drive element;

an extendable portion having a substantially hexagonal shape wherein the extendable portion is capable of being engagingly inserted into the hexagonal opening of the retention sleeve to be substantially retained within the retention housing such that the extendable portion can be one of either inserted into or extend from the retention sleeve to allow a socket mounted onto the extendable portion to access a fastener; and a cap having a set of internal threads that match a set of external threads on the retention sleeve such that tightening of the cap compresses the retainer to deform a hexagonal opening in the retainer to adjust the grip the retainer has on the extendable portion.

2. The telescoping extension tool of claim 1 comprising a cap having a set of external threads that match a set of internal threads on the retention sleeve such that tightening of the cap compresses the retainer to deform a hexagonal opening in the retainer to adjust the grip the retainer has on the extendable portion.

3. The telescoping extension tool of claim 1 further comprising a snap ring installed into a snap ring groove within the retention sleeve such that the snap ring tends to further retain the retainer within the retention sleeve and also tends to inhibit the removal of the extendable portion from the retention sleeve.

4. The telescoping extension tool of claim 1 wherein the extendable portion has a proximal end and a distal end wherein the proximal end has a square end that is sized and configured to engage a standard socket tool.

5. The telescoping extension tool of claim 4 wherein the square end of the extendable portion includes a first detent device that tends to keep the socket tool mounted onto the square end.

6. The telescoping extension tool of claim 5 wherein the extendable portion includes a second detent device position near the distal end of the extendable portion on the surface of the hexagonal shape of the extendable portion wherein the second detent device generally tends to inhibit the removal of the extendable portion from the retention sleeve by at least one of either operatively engaging a set of semispherical indentations located within the hexagonal opening of the retention sleeve, interfering the snap ring, or interfering with the retainer.

7. The telescoping extension tool of claim 6 wherein the retainer is positioned within a counterbore that is coaxial with the hexagonal opening of the retention sleeve wherein the size and shape of the counterbore allows for the placement of the retainer within the retention sleeve.

8. The telescoping extension tool of claim 7 wherein the retainer includes a hexagonal opening sized to accommodate the hexagonal shape of the extendable portion and where the retainer is made from a resilient material selected from the group consisting of neoprene, rubber, vinyl, expanded polystyrene, expanded polypropylene, ethylene-vinyl acetate copolymer, polyethylene, and urethane foam.

9. A telescoping extension tool comprising:

a retention housing;

an extendable portion;

means for retaining the extendable portion within the retention housing wherein the means allows for extending the extendable portion from the retention housing and inserting the extendable portion into the retention housing while tending to retain the extendable portion within the retention housing and wherein the means includes a retention sleeve having a retainer mounted therein such that the retainer tends to retain the extendable portion within the retention sleeve, and wherein the retention sleeve has a square opening at one end of the retention sleeve that is sized and configured to fit a standard socket wrench drive element.

10. The telescoping extension device of claim 9 wherein the distance between having the extendable portion fully inserted into the retention housing and having the extendable portion extended from the retention housing is between about 1.50 inches and about 6.0 inches.

11. The telescoping extension device of claim 10 further comprising means for retention of the retainer within the extension housing in a manner that allows for adjustment of the grip of the retainer of the extendable portion.

* * * * *